US006000231A

United States Patent [19]

Alsenz

[11] Patent Number: 6,000,231

[45] Date of Patent: Dec. 14, 1999

[54] REVERSE LIQUID DEFROST APPARATUS AND METHOD

[76] Inventor: Richard H. Alsenz, 1545 Industrial Dr., Missouri City, Tex. 77489

[21] Appl. No.: 09/006,081

[22] Filed: Jan. 12, 1998

Related U.S. Application Data

[60] Provisional application No. 60/035,164, Jan. 10, 1997.

[51] Int. Cl.[6] ..... F25B 41/00

[52] U.S. Cl. ..... 62/81; 62/278

[58] Field of Search ..... 62/277, 278, 81, 62/196.4, 197

[56] References Cited

U.S. PATENT DOCUMENTS 3,427,819 2/1969 Seghetti ..... 62/278 X
3,633,378 1/1972 Toth ..... 62/278 X
4,083,195 4/1978 Kramer et al. ..... 62/278 X

*Primary Examiner*—Harry B. Tanner
*Attorney, Agent, or Firm*—Baker & Botts, L.L.P.

[57] ABSTRACT

Method and apparatus for defrosting an evaporator in a closed loop refrigeration system are provided. In one embodiment, liquid is circulated from a receiver containing refrigerant through an evaporator in a reverse direction to normal flow and then to another evaporator in the system. Hot gas from a compressor may be used to displace the liquid to the evaporator being defrosted. Alternatively, gas from the top of the receiver may be used for displacement of the liquid. Steps are taken to insure that cold gas from the evaporator that is input to the compressor does not contain liquid. Apparatus making possible flow of liquid in reverse direction through an evaporator selected for defrosting and then to another evaporator is provided, along with apparatus for controlling the flow.

16 Claims, 6 Drawing Sheets

REVERSE LIQUID DEFROST APPARATUS AND METHOD

CROSS-REFERENCE TO RELATED APPLICATIONS

This application is based on provisional application 60/035,164, filed Jan. 10, 1997, entitled "Reverse Liquid Defrost Apparatus and Method", which is incorporated herein by reference in its entirety.

BACKGROUND OF THE INVENTION

Field of the Invention

This invention relates generally to defrosting an evaporator coil in a multiplex evaporator system of a closed loop vapor cycle refrigeration system. More particularly, the present invention is directed to methods, controllers and apparatus for defrosting an evaporator coil of a multiplex evaporator refrigeration system by passing liquid refrigerant in reverse flow through an evaporator and passing the cooled refrigerant into other evaporators in the multiplex system.

Background of the Invention

Multiplexed refrigeration systems sometimes use reverse vapor flow through evaporators to defrost and remove the ice formed on the outside of the evaporator coils as set forth in my U.S. Pat. No. 5,694,782 which is incorporated herein by reference.

During normal operation, the evaporators operate at temperatures low enough to cause water vapor to crystallize or freeze on the outside of the evaporator coils, producing frost or ice which if allowed to build up restricts air flow and eventually results in loss of refrigeration. The rate at which the ice builds up on a particular fixture depends upon the type of the fixture, the load on the fixture, the temperatures of the fixture and refrigerant, and the humidity of the air within the fixture being cooled.

As a result, the surfaces of the evaporator coils require periodic defrosting. The frequency with which a particular evaporator requires defrosting depends on the rate at which ice builds up, the cooling load on the evaporator, and the rate at which it can be defrosted. In general, the length of the defrost period is determined by the degree of ice accumulation on the evaporator and by the rate at which heat can be applied to melt off the ice. Ice and frost accumulation therefore varies with the type of installation, the conditions inside the fixture, and the frequency of defrosting.

BRIEF SUMMARY OF THE INVENTION

The present invention is directed a closed loop vapor cycle refrigeration system, that includes one or more compressors for compressing a refrigerant fluid, a condenser for condensing the compressed gas refrigerant into a liquid refrigerant, a receiver for accumulating liquid refrigerant, a multiplex or plurality of evaporator coils for evaporating the liquid refrigerant to a low pressure gas refrigerant, and a manifold for receiving the refrigerant vapor to be introduced to the compressor(s), a liquid refrigerant flow supply line to the discharge or outlet of each evaporator and control valves in flow lines for introducing the liquid refrigerant into the evaporator coils in reverse circulation for defrosting the evaporator coils. A differential pressure valve is provided to create a liquid refrigerant pressure differential across the evaporator coils to be defrosted which allows the sub-cooled liquid refrigerant to be discharged back into the liquid lines supplying liquid refrigerant to other evaporators in the system.

In one embodiment of the present invention, liquid refrigerant is discharged from the receiver or condenser in reverse flow through an evaporator coil. The liquid refrigerant gives up heat to melt the frost and ice, defrosting the evaporator coil. The refrigerant is simultaneously sub-cooled, thus recovering the cooling effect stored in the accumulated frost and ice. The cooling effect is transferred to other evaporator coils by supplying the sub-cooled liquid to the other evaporator coils as cooler liquid. At the end of the defrost cycle, the defrosting liquid is purged into the liquid line by injecting gas in a maner to minimize the amount of liquid which is left in the coil and suction lines at defrost termination. At the termination point of the defrost cycle, the high pressure gas refrigerant is purged into the manifold or a suction inlet slowly to prevent compressor damage. These purging steps are to prevent liquid slugs from passing through the suction line, which may cause compressor damage. The purging steps are preferably done in a manner to provide the additional advantage of purging all of the sub-cooled defrosting liquid to the other evaporators, thus increasing the recovery by the system of the cooling effect stored in the accumulated frost and ice.

In another embodiment of the invention, a liquid pump is provided in a liquid line to assist the flow of liquid refrigerant to the evaporators during normal operation and in reverse flow during a defrost cycle. This provides the advantage of more rapid defrosting during the defrost cycle or mode and suppression of the vapor formation in the liquid line during the refrigeration cycle. An additional advantage of the present invention is that it may be retrofitted to existing refrigeration systems to increase their defrosting effectiveness.

Important features of the present invention have been broadly summarized above in order that the following detailed description thereof may be better understood, and in order that the contribution to the art may be better appreciated. Additional features of the present invention will be described in detail hereinafter and which will form the subject of the claims appended hereto.

BRIEF DESCRIPTION OF THE DRAWINGS

The following is a brief description of the drawings of the present invention wherein like elements have been identified by like numerals.

DETAILED DESCRIPTION OF THE INVENTION

Closed Loop Vapor Cycle Refrigeration System

Figure 1:
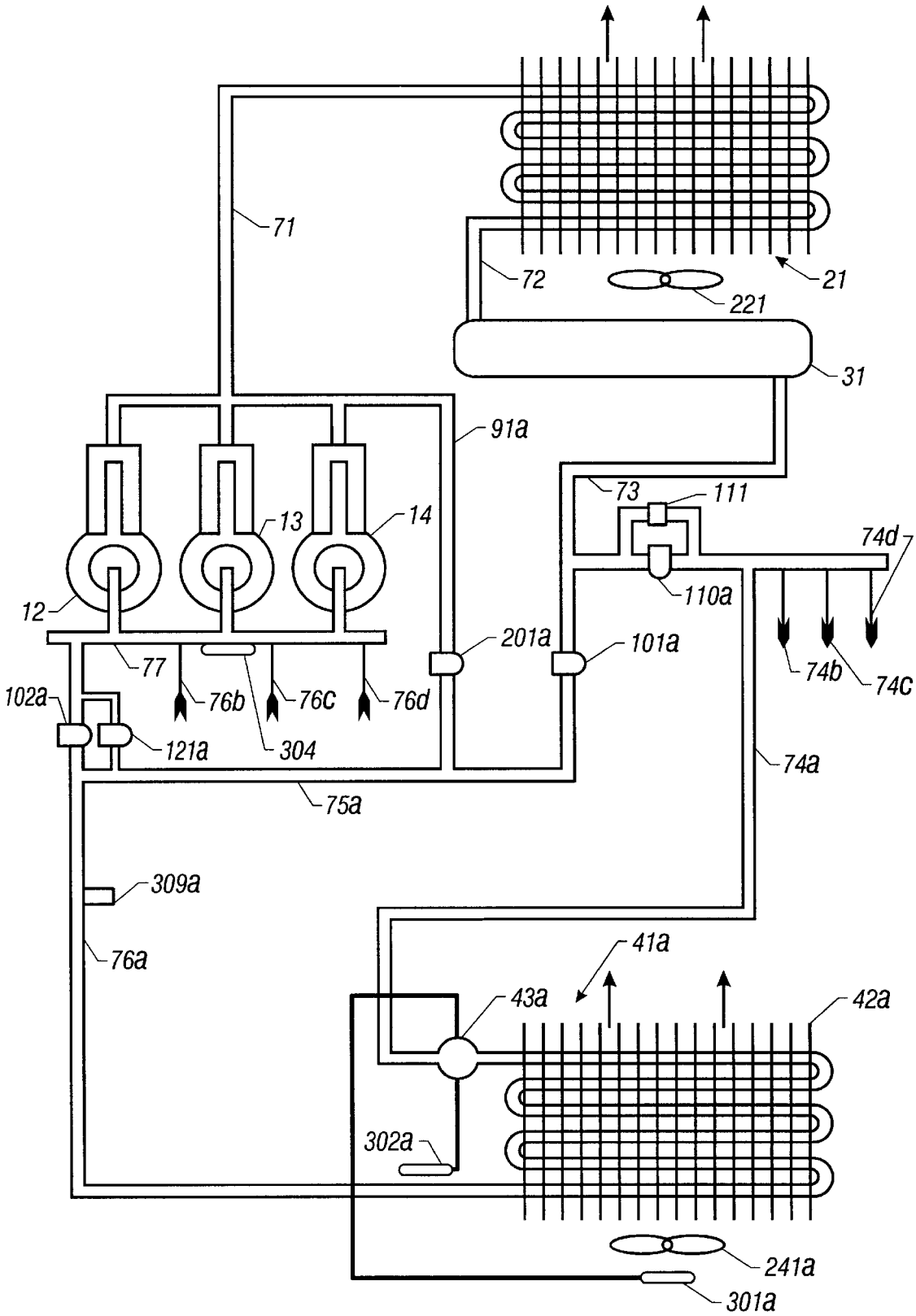
FIG. 1 is a process flow diagram of an embodiment of the closed loop vapor cycle refrigeration system incorporating reverse liquid defrost of an evaporator and hot gas purge.

Referring now to FIG. 1, there is shown a preferred embodiment of a closed loop vapor cycle refrigeration system 10 with reverse liquid defrost in accordance with the present invention. The closed loop vapor cycle refrigeration system includes one or more compressors such as compressors 12, 13, 14, for compressing a vapor refrigerant. Although compressors 12, 13, 14 are shown in FIG. 1 as reciprocating compressors, it should be understood that they may also be centrifugal, rotary, scroll, venturi, jet enthalpy, or other types of compressors as are known in the art without departing from the scope of the invention. The compressed refrigerant flows or passes to a condenser 21 for cooling and condensing the compressed refrigerant and to a reservoir or receiver 31 for collecting the condensed refrigerant, then through a single expansion valve in a multiplex evaporator system or an expansion valve with each evaporator in the system for evaporating the refrigerant to cool a fixture or other refrigerated space surrounding each evaporator. Condenser 21 generally includes a fan 221 for moving ambient air through condenser 21 to facilitate condensing the refrigerant.

In the normal operation of the closed loop vapor cycle refrigeration system, refrigerant vapor line 71 connects the outlets of compressors 12, 13, 14 to condenser 21 for passing the compressed vapor refrigerant to condenser 21. A line 72 connects condenser 21 to a receiver or reservoir 31 for collecting the condensed refrigerant from the condenser 21 to the receiver 31. A liquid line 73 connects an outlet of the receiver 31 to each of the evaporators 41A–D for supplying liquid which is expanded into each evaporator, such as line 74A for supplying liquid to evaporator 41A. Suction lines 76A–D respectively connect the outlets of evaporators 41A–D to suction manifold 77, which is connected to the inlets of compressors 12, 13, 14, for passing refrigerant vapor from evaporators 41A–D to the compressors 12, 13, 14.

Referring now to FIGS. 1, evaporator system 41A will be described in some detail. Although this description is provided as if evaporator 41A is a single evaporator rather than a system, it applies equally to evaporator systems 41B–D, in which like components are present all of which are in parallel. Evaporator system 41A includes one or more evaporator coils such as evaporator coil 42A and an expansion device such as expansion valve 43A for expanding liquid refrigerant into evaporator coil 42A. Evaporator system 41A includes one or more temperature sensors 301A and 302A which may be disposed in suction line 75A at the end of evaporator coil 42A and in the inlet air stream entering evaporator 42A. The signals provided by temperature sensors 301A and 302A are provided to a controller as will be described in more detail hereinafter. Evaporator system 41A includes a frost detecting device 308A, as is known in the art, to provide a signal to a controller indicative of whether a frost condition exists at the coils 42A of evaporator system 41A. Alternatively, a defrost may be initiated by a time clock or other defrost initiating device. Evaporator system 41A also includes a fan 241A for moving air over evaporator coil 42A and for circulating the cooled air to the fixtures and the products being cooled A pressure sensor 309A may be in suction line 76A. All possible temperature and pressure sensors are not shown to operate the refrigeration system. The controllers may be a programmable logic controller, a micro-controller, a microcomputer, or any microprocessor based control circuit as is known in the art for controlling the operations of closed loop vapor cycle refrigeration systems.

Refrigeration System with Reverse Liquid Defrost and Hot Gas Purge

Figure 4:
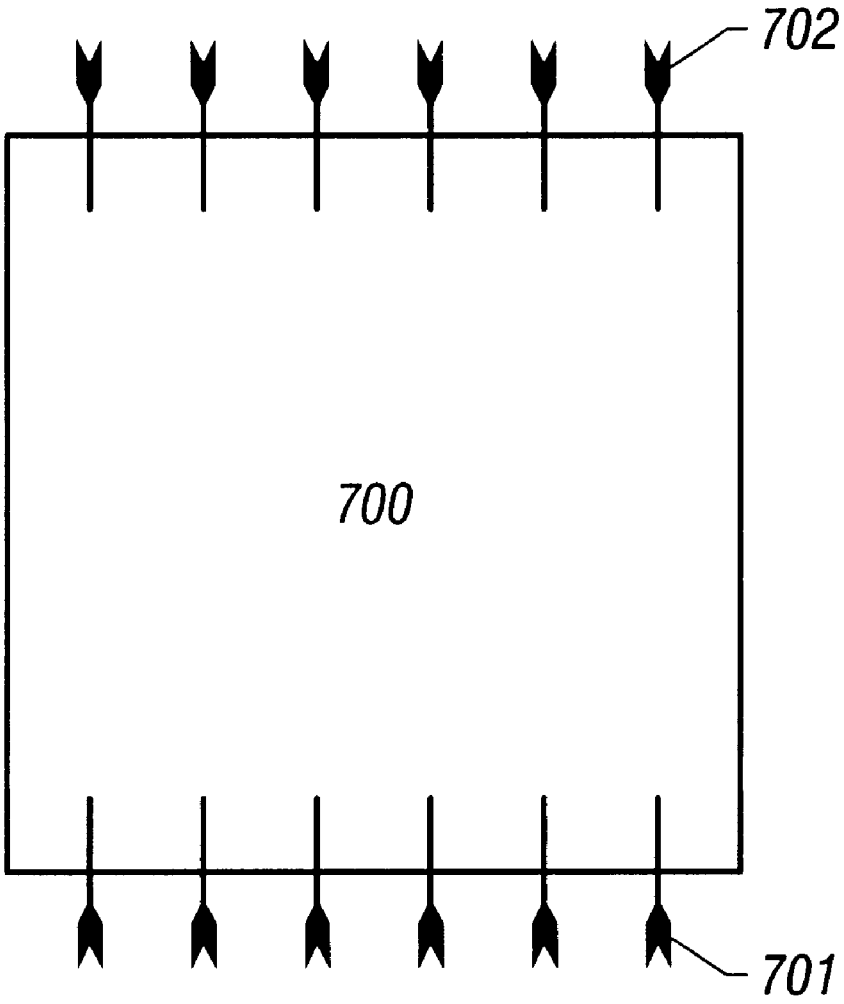
FIG. 4 is a schematic of a controller for carrying out the present invention.

The preferred embodiment of the present invention is shown in FIG. 1. In addition to the closed loop vapor refrigeration system 10 as described above, the present invention includes liquid lines 75 such as liquid line 75A for supplying liquid in reverse flow to evaporator 41A. Liquid line 75A is connected to liquid supply line 73 at one end and to the suction line 76A of evaporator 41A. Also a hot purge gas line 91A is connected at one end to the discharge of the compressors, 12, 13 and 14 or to the line 71 and the other end to the liquid line 75A. Valves to control the flow of fluids are placed in the lines. For example, a liquid valve 101A is disposed in liquid line 75A; a valve 201A is disposed in purge line 91A; a valve 102A is disposed in the suction line 76A and a bypass including a valve 121A. These valves are electrically actuated valves, such as a solenoid valve, but one skilled in the art will recognize that other types of valve may be used without departing from the scope of the invention. Further, these valves are electrically connected to outputs of a controller. Also, a valve 110 is disposed in liquid line 73, a bypass around valve 110 contains a differential pressure valve 111, all of which will be described in more detail hereinafter. The present invention also includes a controller (including the box housing a circuit) 700, as shown in FIG. 4. The controller 700 includes control circuits having inputs 701 for receiving signals from various sensors as will be described, and having outputs 702 for sending control signals to various valves and other devices to control the operation of refrigeration system 10. Control circuit 700 may comprise a programmable logic controller, a microcontroller, a microcomputer, or any microprocessor based control circuit as is known in the for controlling the operations of closed loop vapor cycle refrigeration systems.

A liquid sensor 304 is provided in suction manifold 77 to provide a signal to controller 700 that liquid refrigerant is present in suction manifold 77. Sensor 304 may be a pressure and a temperature transducer. Defrost liquid valves 201A–D, purge valves 203A–D, defrost isolation valves 102A–D, and bypass valves 121A–D are all in electrical connection with, and controlled by, control circuit 700 via outputs 702.

Refrigeration System with Reverse Liquid Defrost and Gas Purge

Figure 2:
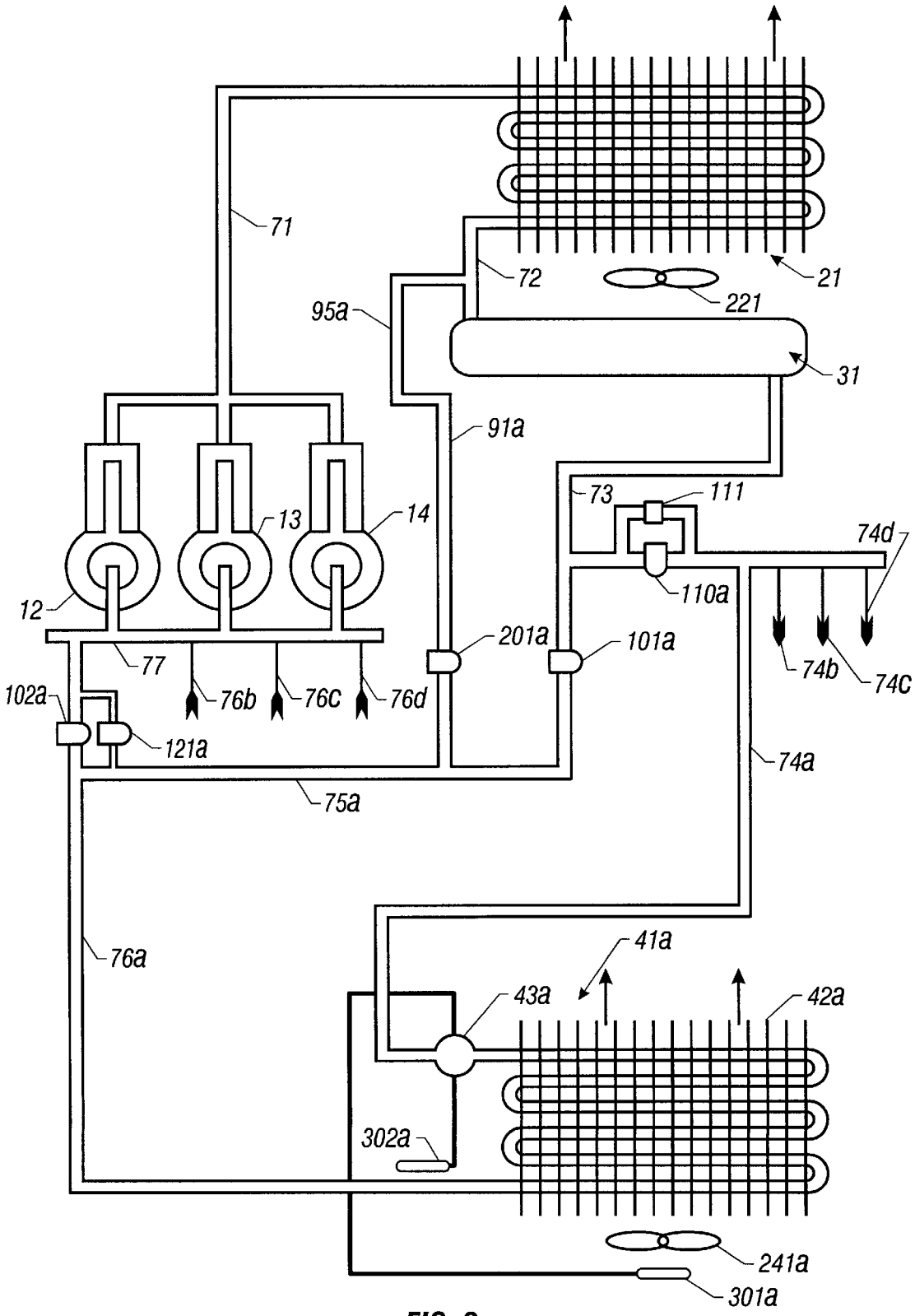
FIG. 2 is a process flow diagram of an embodiment of a closed loop vapor cycle refrigeration system incorporating the purging of the evaporator with a cool gas.

Referring now to FIG. 2, there is shown another embodiment of a closed loop vapor cycle refrigeration system 10 with reverse liquid defrost and a gas purge in accordance with the present invention. In this embodiment, the gas purge is obtained from the top of the receiver 31 rather than the discharge of the compressors. Accordingly, this refrigeration system adds to refrigeration system 10 a gas purge supply line 95A which is connected to the top of the receiver 31 and to the other end to the liquid line 75A.

Figure 3:
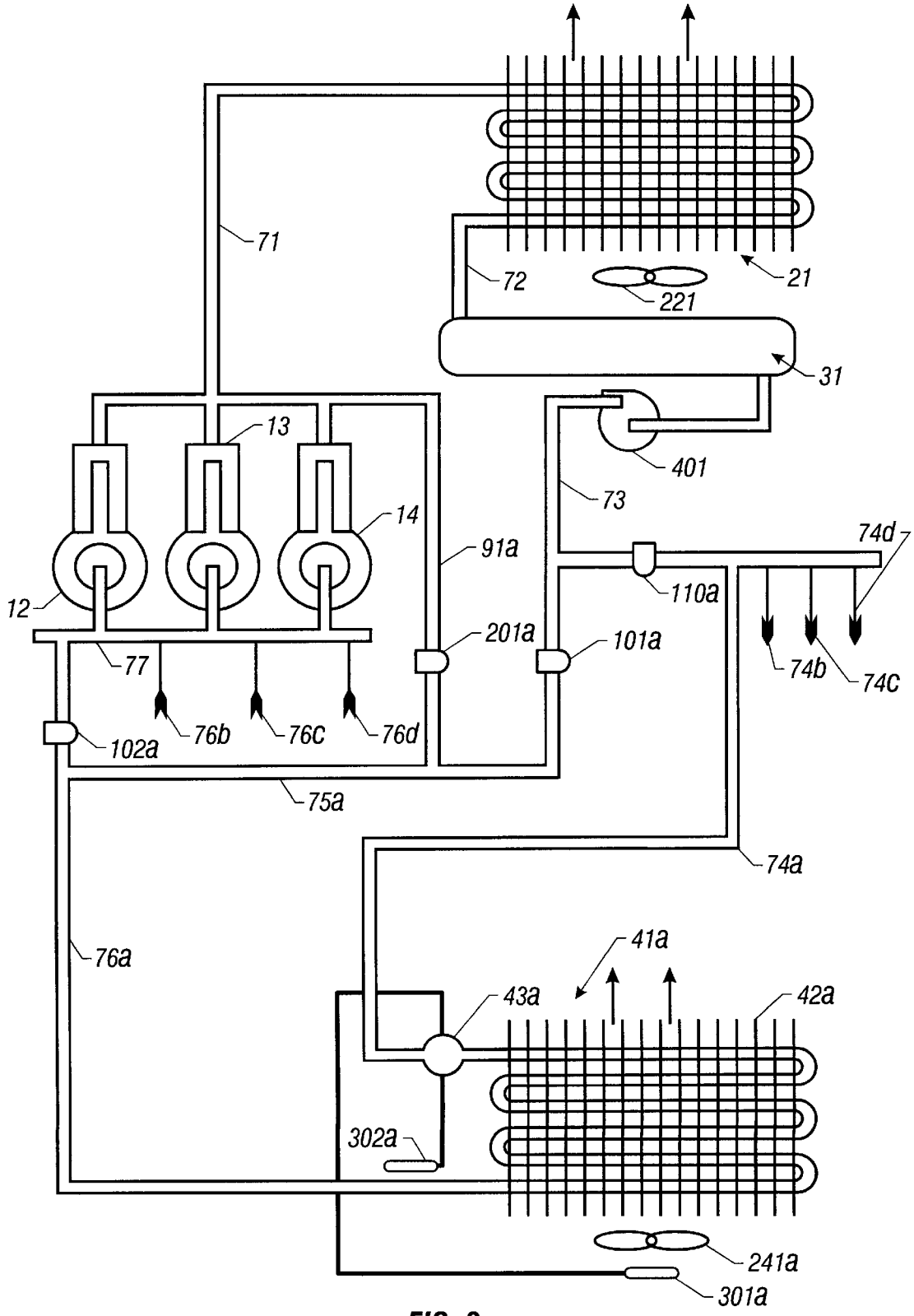
FIG. 3 is a process flow diagram of another embodiment of a closed loop vapor cycle refrigeration system incorporating reverse liquid defrost including a liquid pump.

Refrigeration System with Reverse Liquid Defrost, Hot Gas Purge, and Liquid Pump Referring now to FIG. 3, there is shown another embodiment of a closed loop vapor cycle refrigeration system with reverse liquid defrost, a hot gas purge, and a liquid pump in accordance with the present invention. In this refrigeration system 10, a liquid pump 401 is disposed in liquid line 73, for increasing the pressure of liquid supplied to liquid line 75A. Liquid pump 401 may be a fixed speed or variable speed centrifugal pump, but one skilled in the art will recognize that many types of pumps may be successfully employed without departing from the scope of the invention.

Normal Operation

Referring now to FIG. 1, a normal operation of refrigeration system 10 is described wherein no evaporators are being defrosted. Therefore, valves 110 and 102A–D are open, and valves 201A–D and 1O1A–D closed. Low pressure vapor refrigerant is compressed to a high pressure by compressors 12, 13, and 14. The compressed vapor refrigerant is discharged into vapor line 71 and flows to condenser 21. Condenser 21 cools and condenses the refrigerant vapor by transferring heat from the refrigerant vapor to ambient air, which may be forced through condenser 21 by fan 221. The condensed liquid is discharged from condenser 21 through line 72 into receiver 31. The liquid refrigerant from receiver 31 flows through liquid line 73, through open valve 110, to evaporators 41A–D, specifically line 74A to evaporator 41A.

At evaporator 41A, the liquid is expanded to a vapor and cooled by passing through expansion valve 43A. The vapor then flows through evaporator coils 42A where it absorbs heat from the air passing over the coil and cools the air passing to the fixture or refrigerated space to be cooled. The transfer of heat circulated from the fixture or refrigerated space to the vapor may be enhanced by fan 241. The vapor then flows through suction line 76A, through open isolation valves 102A, to suction manifold 77 and into the inlets of compressors 12, 13, and 14. The above described refrigeration cycle is continuously taking place with each of the evaporators 41A–D in normal operation of refrigeration systems 10.

Defrosting an Evaporator

Figure 5:
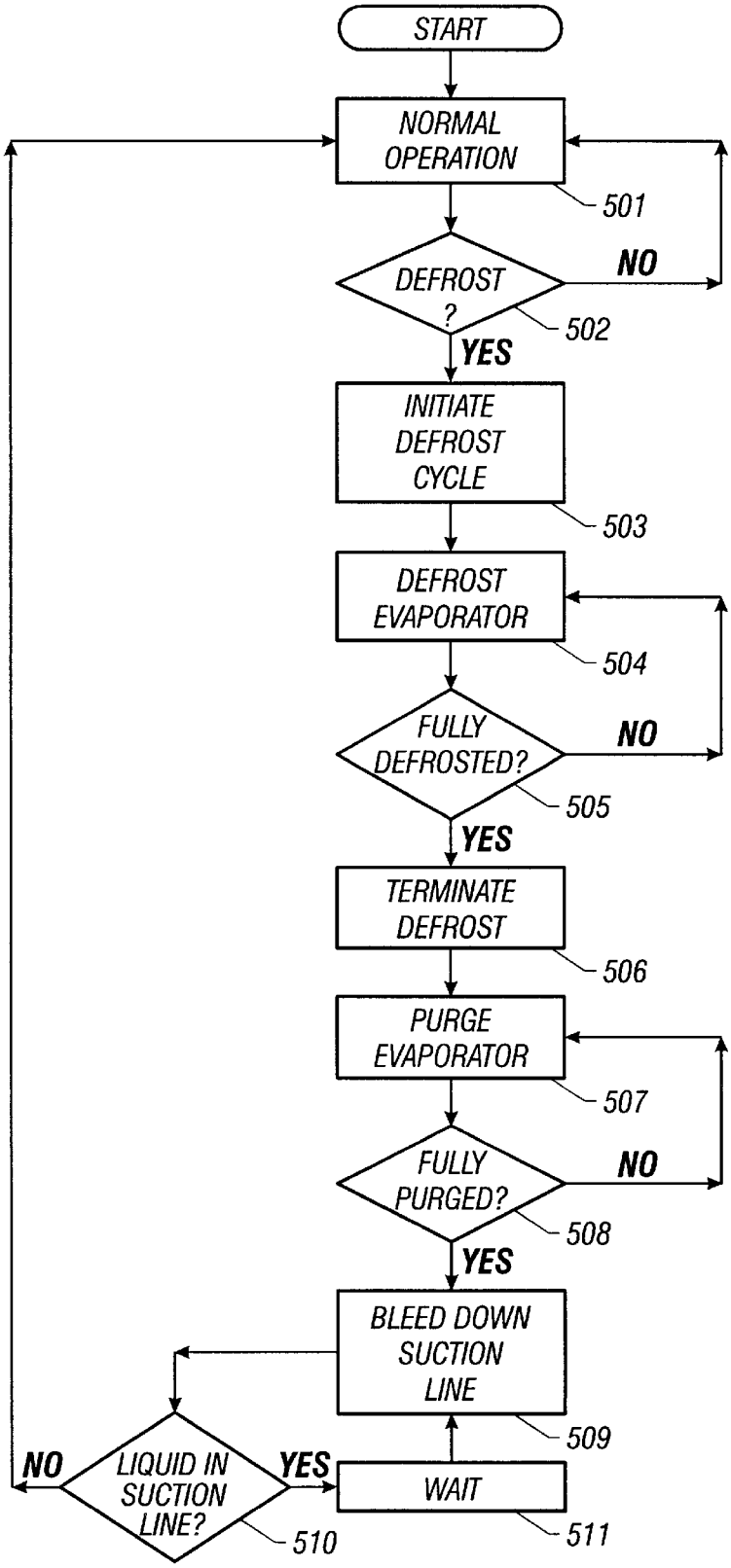
FIG. 5 is simplified block flow diagram of a reverse flow liquid defrost cycle control sequence.

The control sequence for refrigeration systems in accordance with the present invention is shown generally in the simplified block flow diagram of FIG. 5. The normal state of the system is indicated by step 501. The sensors associated with the evaporators, fixtures, or refrigerated spaces are tested regularly in normal operation for frost. When a frost condition is detected by the controller 700 from the test at step 502, the defrost cycle is initiated (step 503) for the evaporator that needs to be defrosted. The evaporator is then defrosted by the reverse flow of liquid refrigerant, indicated by step 504. When the evaporator is determined to be fully defrosted (see test at step 505) defrosting is terminated (step 506). Purging of the evaporator is then initiated. See step 507. When the evaporator is purged (test at step 508), the suction line is bled down at step 509. During the bleeding down of the suction line, the suction manifold is tested for the presence of liquid (step 510). If liquid is detected at step 510, a wait period is imposed (step 511) to allow the liquid to vaporize, thus preventing compressor damage. When the suction line is bled down and no liquid is present in the suction manifold, normal operation is resumed. See step 501. These steps will now be described in somewhat greater detail.

Detecting a Frost Condition

A defrost cycle will now be described for the exemplary case where a frost condition is detected at the coils 42A of evaporator 41A of the refrigeration system. See FIG. 1. The operation of refrigeration system is controlled by controller 700, and the defrost cycle may be better understood by reference to the block flow diagram of FIG. 6.

When an evaporator, such as evaporator 41A accumulates sufficient frost or ice on its evaporator coil 42A its cooling performance will degrade and the temperature of the fixture or refrigerated space to be cooled will not be maintained at the desired temperature. Such a frost condition is detected by the frost sensor 308A which then sends an electrical signal indicative of a frost condition to controller 700. A defrost cycle may also be automatically initiated by controller 700 whenever a predetermined time period in normal operation has passed for a given evaporator.

Initiating the Defrost Cycle

Figure 6:
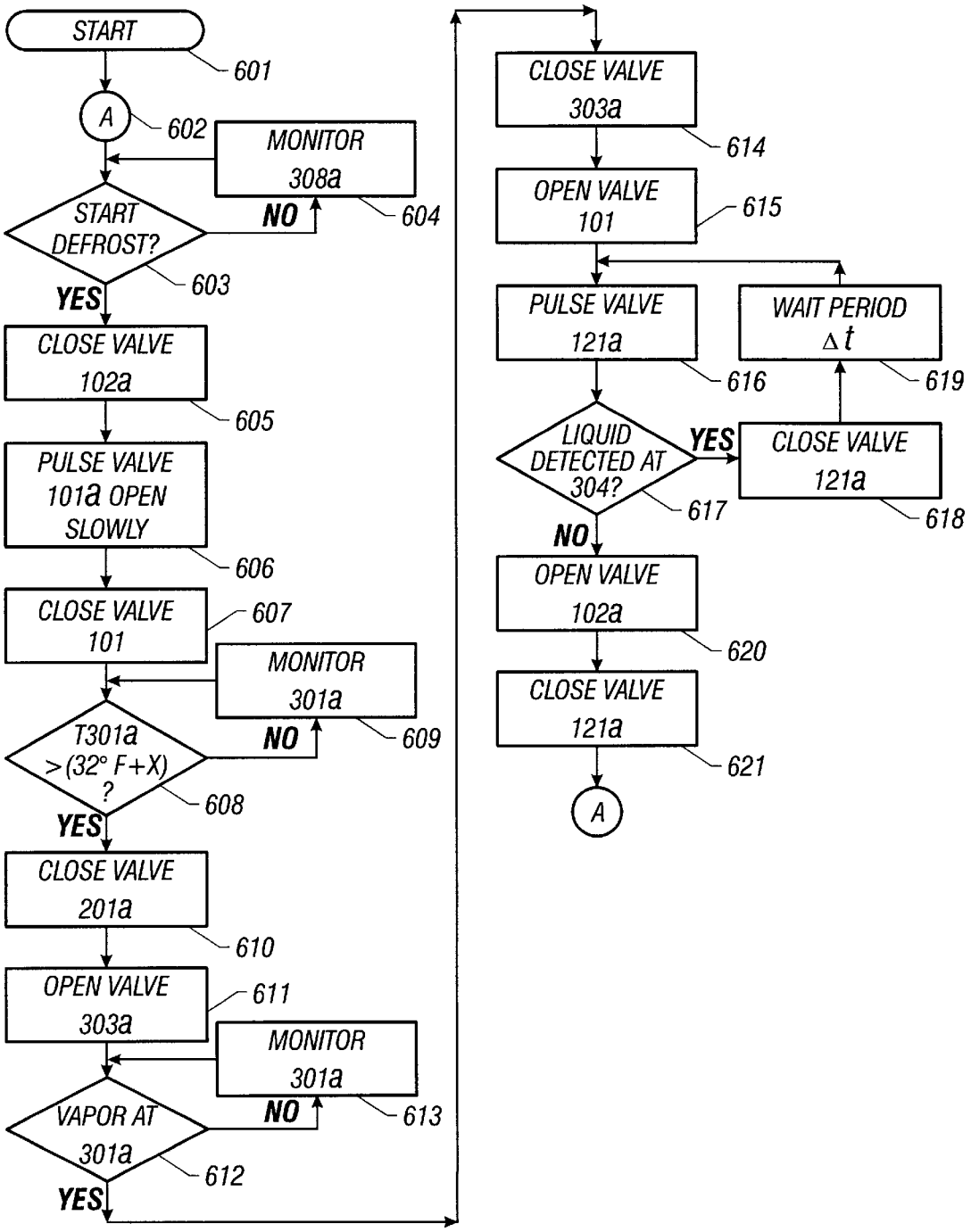
FIG. 6 is a simplified block flow diagram of a reverse flow liquid defrost cycle control sequence including the purging stage.

The control circuit 700 monitors frost sensor 308A in normal operation, as indicated by step 604 of FIG. 6. When a frost condition is detected by frost sensor 308A at evaporator 41A, a defrost cycle is then initiated by control circuit 700 for evaporator 41A at step 603. Isolation valve 102A is then closed to isolate suction line 76A from suction manifold 77. See step 605. Defrost supply valve 101A in liquid line 75A is then either opened slowly or pulsed open (step 606) to pressurize suction line 76A slowly with defrosting liquid from defrost supply line 73. The slow pressurization of suction line 76A prevents shocking suction line 76A. Valve 110 is then closed in step 607, and liquid refrigerant bypasses valve 110 through pressure differential valve 111 when the pressure in line 73 exceeds the threshold differential pressure setting of valve 111, such as 20 pounds per square inch (psi). It is desired that suction line 76A is pressurized slowly and liquid refrigerant bypasses valve 110 through pressure differential valve 111 to supply the other evaporators. Thus, valve 110 may be closed before defrost supply valve lOlA is opened to pressurize the suction line with defrosting liquid.

Defrosting the Evaporator

Evaporator 41A is now defrosted by the reverse flow of liquid refrigerant through suction line 76A and evaporator coil 42A. The liquid refrigerant releases heat as it flows through coil 42, melting the ice that has accumulated on the coil 42A, thus defrosting the coil. At the same time the liquid refrigerant is sub-cooled. The flow of defrosting liquid during defrost may be controlled either by defrost supply valve 101A or by expansion valve 43A. Expansion valve 43A must be able to allow reverse flow or be modified with a by-pass check valve. In either case, the liquid exits evaporator 41A and flows into liquid line 74A in reverse flow, and then flows to the inlets of the non-defrosting evaporators 41B–D along with the liquid bypassing around valve 101 into line 73. The cooling effect of the frost and ice on the coils 42A of evaporator 41A is thus recovered by the liquid refrigerant and transferred to the other evaporators 42B–D.

Terminating the Defrost Cycle

During the defrost cycle, the signal from temperature sensor 301A is monitored. See step 609. When coil 42A has defrosted, the temperature of the defrosting liquid exiting evaporator 41A will rise above 32° F. When the temperature of the exiting liquid exceeds 32° F. by a predetermined amount, it is reasonably certain that the coils 42A are fully defrosted. This test is made by controller 700 in step 608. In the case where expansion valve 43A is known to frost up, temperature sensor 301A should be positioned downstream of expansion valve 43A (in reverse flow). See FIG. 4. This ensures that the defrost cycle continues until expansion valve 43A has fully defrosted.

Purging the Defrosted Evaporator

When the evaporator coil 42A is fully defrosted (see test at step 608) the flow of defrosting liquid is stopped by closing valve 101A, as shown in step 610. Purge gas valve 201A is then opened in step 611. The purge gas then flows through purge line 91A into defrost line 75A and suction line 76A, forcing most of the defrosting liquid out of evaporator 41A and into the non-defrosting evaporators 41B–D. The purging of suction line is complete when the purge gas reaches the evaporator 41A. This condition may be determined by, for example, monitoring the signal from temperature sensor 301A at the evaporator outlet(step 613) until it exceeds a predetermined value, such as the condensing temperature. This condition may also be determined by optically sensing the presence of vapor. When it is determined that the suction line 76A is fully purged (step 612), the purge gas valve 201A is closed. See step 614.

Bleeding Down the Suction Line

Valve 110 is then opened to begin restoring normal refrigerant flow, as shown in step 615. Bleed down valve 121A (see FIG. 1) is then pulsed (cycled) as indicated by step 616 to slowly bring down the pressure of suction line 76A. Should any liquid be present in suction line 76A, this pulsing of valve 121A allows only a small amount to pass to suction manifold 77, to prevent damage to the compressors 12, 13, and 14. As suction line 76A is bleeding down, liquid sensor 304 is closely monitored as indicated in step 617. If liquid is detected in suction manifold 77, valve 121A is closed (step 618) and a wait period is initiated (step 619).

Resuming Normal Operation

The wait period (step 619) provides time for the liquid in suction manifold 77 to vaporize into the refrigerant vapor passing through suction manifold 77 from suction lines 76B–D. Valve 121A is pulsed again (step 616) and, if no liquid is detected in suction manifold 77 at step 617, isolation valve 102A is opened (step 620). Bleed down valve 121A is then closed (step 621) and normal operation is resumed. See step 602.

As an alternative to pulsing bleed down valve 121A, isolation valve 102A may itself be pulsed, or throttled open, to slowly bleed down suction line 76A, while liquid sensor 304 is monitored carefully. Should liquid be detected during the pulsing or opening of valve 102A, a wait period should be initiated or valve 102A should be throttled back.

Referring now to FIGS. 2 and 3, the operation of the defrost cycle of the refrigeration system is essentially the same as that described above with respect to FIG. 1.

The foregoing descriptions are directed to particular embodiments of the invention for the purpose of illustration and explanation. It will be apparent, however, to one skilled in the art that many modifications and changes to the embodiments set forth above are possible without departing from the scope and the spirit of the invention. It is intended that the following claims be interpreted to embrace all such changes and modifications.

I claim:

1. A method for defrosting an evaporator in a closed loop refrigeration system having a plurality of evaporators, each evaporator having an inlet for normal forward flow and an outlet, comprising the steps of:

providing a receiver for liquid refrigerant and a liquid reverse flow line between the receiver and a selected evaporator for flowing liquid refrigerant to the outlet of the selected evaporator in reverse flow, the reverse flow line having a liquid reverse flow valve therein;

providing a compressor having an outlet and an inlet;

providing a liquid forward flow line between the receiver and the inlet of the selected evaporator for supplying liquid refrigerant to the selected evaporator in normal forward flow, the forward flow line having a liquid forward flow valve therein;

providing a cold gas flow line between the outlet of the selected evaporator and the inlet of the compressor for supplying cold gas to the compressor, the cold gas flow line having a cold gas flow valve therein;

closing the cold gas flow line valve;

opening the liquid reverse flow valve;

closing the liquid forward flow valve, allowing liquid to flow in backward flow through the selected evaporator and through a flowline provided to the inlet of a non-selected evaporator; and flowing liquid refrigerant from the receiver through the selected evaporator in the reverse direction and to the non-selected evaporator until the selected evaporator is defrosted.

2. The method of claim 1 further comprising the step, before the step of closing the cold gas flow line valve, of monitoring the selected evaporator for the presence of frost.

3. The method of claim 1 wherein the step of flowing the liquid refrigerant from the receiver in backward flow through the selected evaporator includes pumping the liquid.

4. The method of claim 1 further comprising the step of monitoring a temperature to indicate when the selected evaporator or an expansion valve attached thereto is defrosted.

5. The method of claim 1 further comprising the steps of closing the liquid reverse flow valve and displacing liquid refrigerant to the selected evaporator with gas then opening the cold gas flow valve to lower pressure in the cold gas flow line.

6. The method of claim 5 wherein the step of displacing liquid refrigerant to the selected evaporator with gas includes opening a hot gas flow valve that is provided in a hot gas flow line provided from the outlet of the compressor for a time sufficient to displace liquid refrigerant to the selected evaporator then closing the hot gas flow valve.

7. The method of claim 5 wherein the step of displacing liquid refrigerant to the selected evaporator with gas includes opening a warm gas flow valve that is provided in a warm gas flow line provided from the receiver for a time sufficient to displace liquid refrigerant to the selected evaporator then closing the warm gas flow valve.

8. The method of claim 5 wherein the cold gas flow valve is opened by pulsing so as to lower the pressure at a controlled rate.

9. The method of claim 5 additionally comprising the step of monitoring the cold gas flow line for liquid in the line.

10. The method of claim 1 further comprising the step of providing a differential pressure valve in the liquid forward flow line in parallel with the liquid forward flow line valve so as to cause liquid to flow in the liquid forward flow line when a selected differential pressure is present across the differential pressure valve.

11. A closed loop refrigeration system, comprising:

a plurality of evaporators, the evaporators having an outlet and an inlet for normal forward flow;

a condensor having an outlet and an inlet;

a receiver for liquid refrigerant and a flow line connecting the outlet of the condensor and the receiver;

a compressor having an outlet and an inlet and a flow line connecting the outlet of the compressor and the inlet of the condensor;

a flow line connecting the receiver and the outlet of a selected evaporator, the flow line having a valve therein;

a flow line connecting the receiver and the inlet of the selected evaporator, the flow line having a flow valve therein;

a gas flow line connecting the outlet of the selected evaporator and the inlet of the compressor, the gas flow line having a gas flow valve therein;

a flow line connecting a low-pressure side of the forward flow valve to a second evaporator; and flow lines and valves connecting a second evaporator to the receiver and compressor as the selected evaporator is connected.

12. The system of claim 11 further comprising a temperature sensor for monitoring a temperature indicative of the defrosting of the selected evaporator.

13. The system of claim 11 further comprising a monitor for liquid in the flow line connecting the outlet of the selected evaporator and the inlet of the compressor.

14. The system of claim 11 further comprising a sensor for detecting frost on the selected evaporator.

15. The system of claim 11 further comprising a flow line connecting the outlet of the compressor to the outlet of the selected evaporator, the flow line having a valve therein.

16. The system of claim 11 further comprising a flow line connecting the receiver and the inlet of the selected evaporator, the flow line having a valve therein.

* * * * *